US010697267B2

(12) United States Patent
Urban, II et al.

(10) Patent No.: US 10,697,267 B2
(45) Date of Patent: Jun. 30, 2020

(54) ADJUSTABLE PACKING ELEMENT ASSEMBLY

(71) Applicants: Larry Joseph Urban, II, Santa Fe, TX (US); Gary L. Anderson, Humble, TX (US)

(72) Inventors: Larry Joseph Urban, II, Santa Fe, TX (US); Gary L. Anderson, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 169 days.

(21) Appl. No.: 15/963,168

(22) Filed: Apr. 26, 2018

(65) Prior Publication Data

US 2019/0330956 A1 Oct. 31, 2019

(51) Int. Cl.
*E21B 33/128* (2006.01)

(52) U.S. Cl.
CPC ..... *E21B 33/128* (2013.01)

(58) Field of Classification Search
CPC ..... E21B 33/1216; E21B 33/128; E21B 33/1208; E21B 23/06; E21B 33/12; E21B 33/1285; E21B 33/129
See application file for complete search history.

(56) References Cited

U.S. PATENT DOCUMENTS 4,288,082 A * 9/1981 Setterberg, Jr. ..... E21B 33/1216 166/118
4,457,369 A * 7/1984 Henderson ..... E21B 33/1293 166/125
7,373,973 B2 * 5/2008 Smith ..... E21B 33/1216 166/134
8,459,346 B2 * 6/2013 Frazier ..... E21B 33/134 166/124
8,899,317 B2 * 12/2014 Frazier ..... E21B 33/129 166/123
9,228,411 B2 * 1/2016 Themig ..... E21B 33/1216
10,443,343 B2 * 10/2019 Doane ..... F16J 15/3268
2003/0226660 A1 * 12/2003 Winslow ..... E21B 33/1216 166/118
2006/0289173 A1 * 12/2006 Conaway ..... E21B 33/1216 166/387
2009/0255690 A1 10/2009 Conner et al.
2010/0101804 A1 * 4/2010 Vinson ..... E21B 33/1216 166/377

(Continued)

OTHER PUBLICATIONS

International Search Report and Written Opinion for International Application No. PCT/US2019/023872; International Filing Date Mar. 25, 2019 (pp. 1-7).

*Primary Examiner* — Daniel P Stephenson
(74) *Attorney, Agent, or Firm* — Cantor Colburn LLP

(57) ABSTRACT

An adjustable packing element assembly includes a tubular, and a packing element supported by the tubular. The packing element includes a first end portion and a second end portion. A backup ring is arranged at the first end portion. The backup ring includes a first section mounted to the tubular and a second section extending over the packing element. An expandable ring is mounted to the backup ring. The expandable ring includes a selectively expandable portion. An adjustable sleeve is mounted to the expandable ring. The adjustable sleeve is selectively arranged to constrain an amount of expansion of the selectively expandable portion.

10 Claims, 5 Drawing Sheets

(56) References Cited

U.S. PATENT DOCUMENTS

| | | | | |
|---|---|---|---|---|
| 2011/0048744 | A1 | 3/2011 | Conner et al. | |
| 2012/0133098 | A1* | 5/2012 | Farquhar | E21B 33/128 277/314 |
| 2013/0306330 | A1* | 11/2013 | Bishop | E21B 33/1216 166/387 |
| 2014/0290946 | A1* | 10/2014 | Nguyen | E21B 33/1204 166/285 |
| 2015/0060088 | A1 | 3/2015 | Goodman et al. | |
| 2015/0198005 | A1 | 7/2015 | Delzell et al. | |
| 2016/0084036 | A1* | 3/2016 | Themig | E21B 33/1216 166/387 |
| 2016/0090813 | A1 | 3/2016 | Conner et al. | |
| 2019/0330956 | A1* | 10/2019 | Urban, II | E21B 33/128 |

* cited by examiner

ADJUSTABLE PACKING ELEMENT ASSEMBLY

BACKGROUND

In the resource exploration and recovery industry, boreholes may be formed in a resource bearing formation. A tubular may then be extended into the casing. The resource bearing formation may include various zones of interest. A casing may be extended into the resource bearing formation. Seals or packers may be deployed from the tubular outwardly against the casing to isolate one zone of interest from another. At this point, the casing may be selectively perforated in order to introduce fluids from the tubular into the formation or vice-versa.

Depending upon various constraints, an inner diameter of the casing may vary from installation to installation. Similarly, an outer diameter of the tubular may vary. The different sized casings and tubulars leads to various clearances for the packer to span in order to isolate the resource bearing zones. Deploying a packer across too large a span may result in a poor seal quality. Changing packers prior to installation in the field is a difficult and time consuming process. Accordingly, the art would be receptive to a system for adjusting a packer that may be operated on-site.

SUMMARY

Disclosed is an adjustable packing element assembly including a tubular and a packing element supported by the tubular. The packing element includes a first end portion and a second end portion. A backup ring is arranged at the first end portion. The backup ring includes a first section mounted to the tubular and a second section extending over the packing element. An expandable ring is mounted to the backup ring. The expandable ring includes a selectively expandable portion. An adjustable sleeve is mounted to the expandable ring. The adjustable sleeve is selectively arranged to constrain an amount of expansion of the selectively expandable portion.

Also disclosed is a resource exploration and recovery system including a first system and a second system operatively connected to the first system. The second system includes at least one tubular. An adjustable packing element assembly includes a tubular and a packing element supported by the tubular. The packing element includes a first end portion and a second end portion. A backup ring is arranged at the first end portion. The backup ring includes a first section mounted to the tubular and a second section extending over the packing element. An expandable ring is mounted to the backup ring. The expandable ring includes a selectively expandable portion. An adjustable sleeve is mounted to the expandable ring. The adjustable sleeve is selectively arranged to constrain an amount of expansion of the selectively expandable portion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
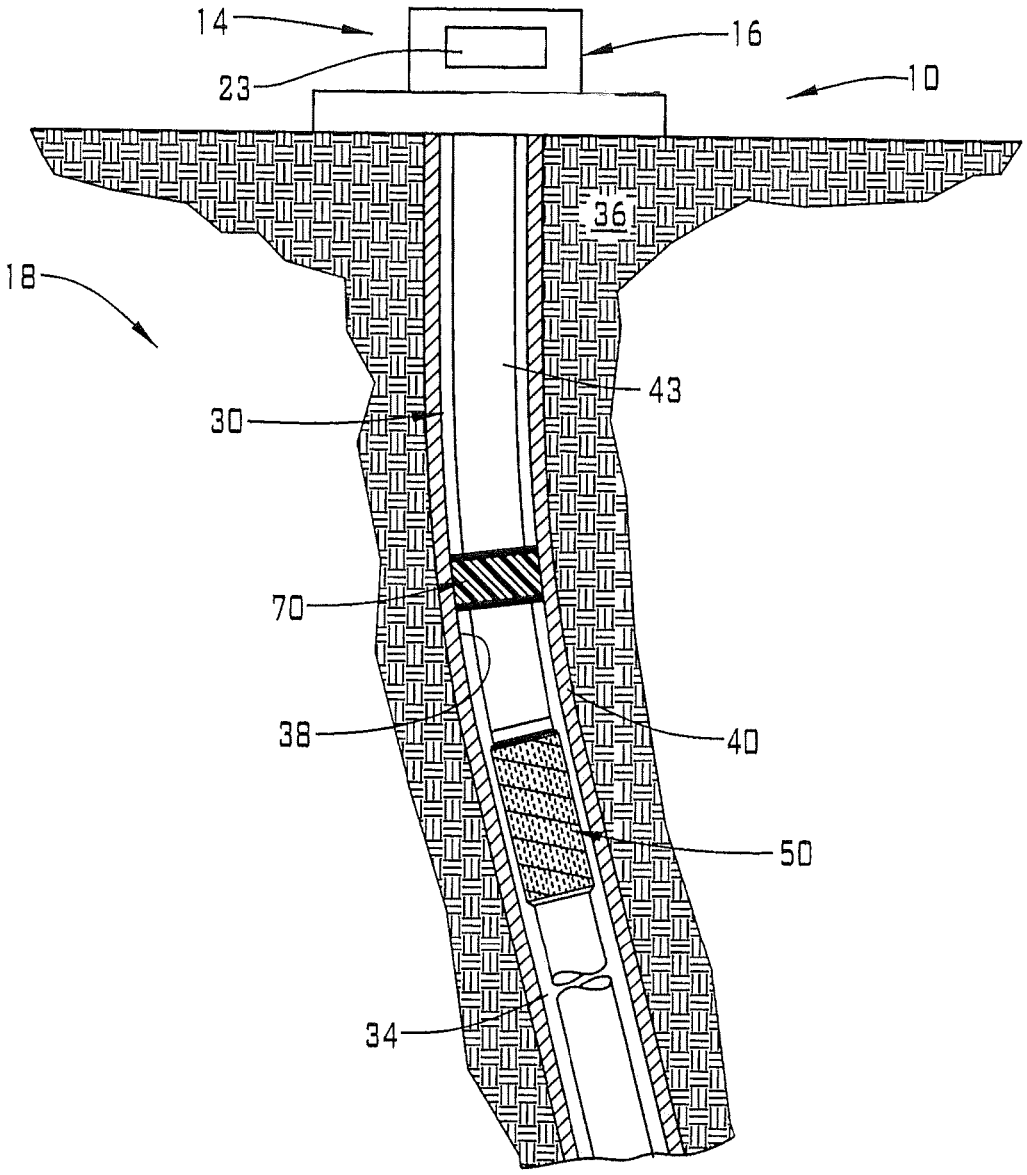
FIG. 1 depicts a resource exploration and recovery system including an adjustable packing element assembly, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations. First system 14 may also include additional systems such as pumps, fluid storage systems, cranes and the like (not shown).

Second system 18 may include a tubular string 30 that extends into a wellbore 34 formed in formation 36. Wellbore 34 includes an annular wall 38 which may be defined by a surface of formation 36, or, in the embodiment shown, by a casing tubular 40. Tubular sting 30 may be formed from a single tubular 43 that could take the form of coiled tubing or, by a series of interconnected discrete tubulars. Tubular string 30 may support one or more screen assemblies, such as indicated at 50, as will be discussed herein In an embodiment, tubular string 30 is shown to support an adjustable packing element assembly 70 that may be selectively deployed against casing tubular 40 to establish a zone boundary. Specifically, a number of adjustable packing element assemblies (not shown) may be arranged along tubular string 30 to form a plurality zones (not separately labeled) in formation 36. Each zone may include a corresponding a screen assembly that may operate to filter outgoing or incoming fluids.

In accordance with an exemplary embodiment, adjustable packing element assembly 70 includes a packing element 80 mounted to an outer surface (not separately labeled) of tubular string 30. Packing element 80 includes an annular profile 82 having a first end portion 84 and a second end portion 85. Packing element 80 may expand radially outwardly when compressed. That is, when a compressive force is applied to first and second end portion 84 and 85, packing element 80 may expand radially outwardly towards and engage with annular wall 38.

Adjustable packing element assembly 70 also includes a first back-up ring 88 arranged at first end portion 84 and a second back-up ring 89 arranged at second end portion 85. As each back-up ring 88 and 89 is substantially similar, a detailed description will follow referencing first back-up ring 88 with an understanding that second back-up ring 89 includes corresponding structure. First back-up ring 88 includes a first section 92 mounted at tubular string 30 and a second, deformable section 93. Deformable section 93 may deflect radially outwardly when contacted by packing element 80. First section 92 includes an outer surface (not separately labeled) having a plurality of threads 96.

Adjustable packing element assembly 70 also includes a first expandable ring 104 arranged at first end portion 84 and a second expandable ring 105 arranged at second end portion 85. As each expandable ring 104, 105 is substantially similar, a detailed description will follow with respect to first expandable ring 104 with an understanding that second expandable ring 105 includes corresponding structure. First expandable ring 104 includes a first portion 110 and a second portion 112 separated by a step region 114. Step region may be receptive of first section 92 of first back-up ring 88.

Second portion 112 includes an inner surface 117 having a plurality of threads 119 that may inter-engage with the plurality of threads 96 on first back-up ring 88. First portion 110 includes an outer surface 121 having a plurality of threads 122. First expandable ring 110 includes a selectively expandable portion 124 that extends axially outwardly of second portion 112. Selectively expandable portion 124 provides mechanical support to deformable section 93 of first back-up ring 88.

In accordance with an exemplary aspect, adjustable packing element assembly 70 includes a first adjustable sleeve 134 that may be selectively axially positioned relative to first expandable ring 104 and a second adjustable sleeve 135 that may be selectively axially positioned relative to second expandable ring 105. As each adjustable sleeve 134, 135 is substantially similar, a detailed description will follow with respect to first adjustable sleeve 134 with an understanding that second adjustable sleeve 135 includes corresponding structure.

First adjustable sleeve 134 includes a body 138 having an axial end portion 140 that defines a travel limiter 142 as will be discussed herein. Body 138 also includes an inner surface 145 having a plurality of threads 148. Plurality of threads 148 engage with plurality of threads 122 on outer surface 121 to selectively position adjustable sleeve 134 relative to first expandable ring 104. Once in position, a locking mechanism 150 may be activated to secure adjustable ring 134 in the selected position. Locking mechanism 150 may take the form of a lock screw 152 that is tightened against first expandable ring 104.

Figure 2:
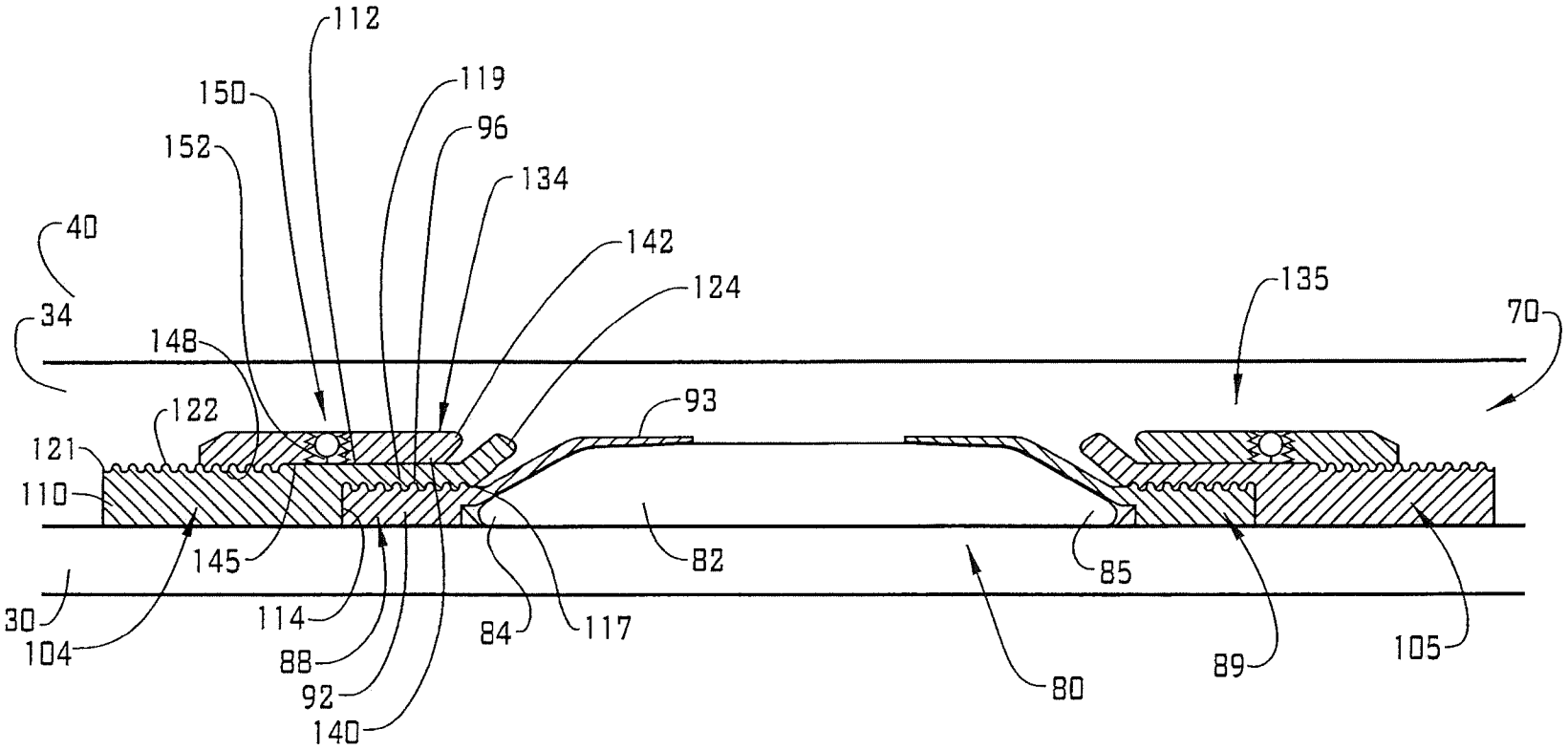
FIG. 2 depicts the adjustable packing element assembly of FIG. 1 in a first adjusted configuration, in accordance with an aspect of an exemplary embodiment.
Figure 3:
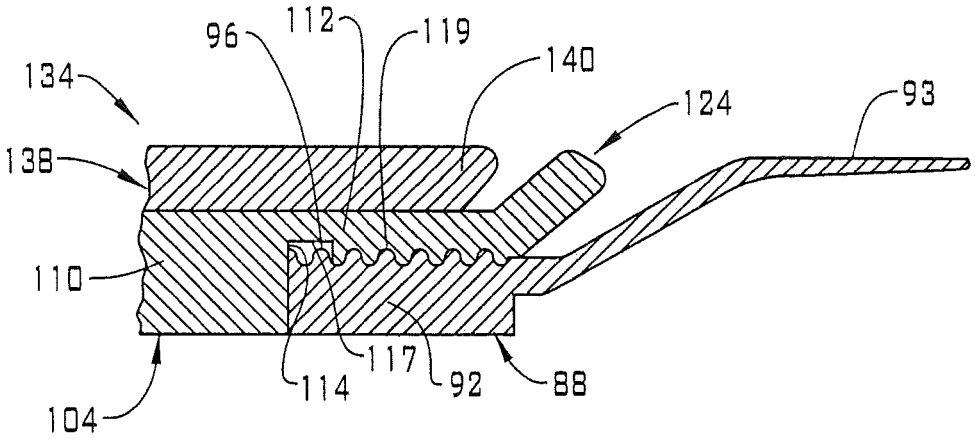
FIG. 3 depicts a first portion of the adjustable packer assembly of FIG. 2 prior to packing element expansion, in accordance with an aspect of an exemplary embodiment.
Figure 4:
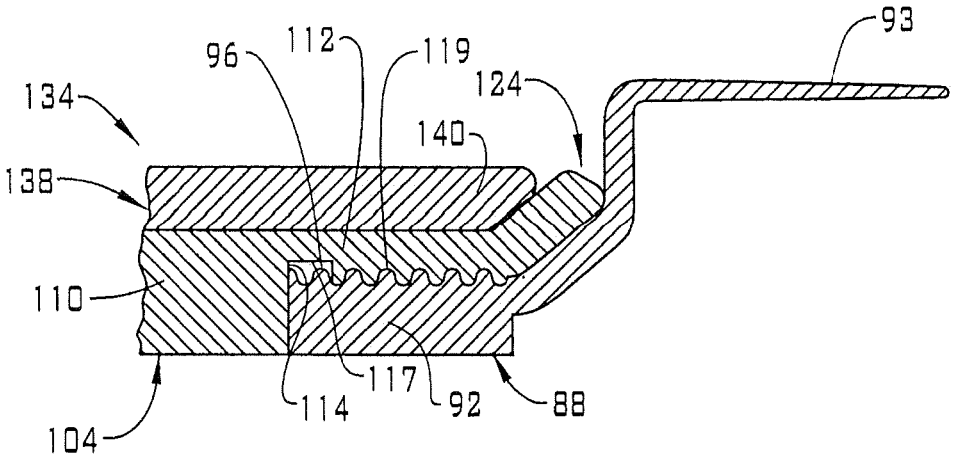
FIG. 4 depicts the first portion of the adjustable packer assembly of FIG. 3 after packing element expansion, in accordance with an aspect of an exemplary embodiment.

In accordance with an exemplary aspect, first and second adjustable sleeves 134 and 135 may be positioned relative to first and second expandable rings 104 and 105 to establish a selected amount of expansion that corresponds to a casing diameter. For example, as shown in FIGS. 2 and 3, first adjustable sleeve 134 may be positioned on first expandable ring 104 such that travel limiter 142 is spaced from selectively expandable portion 124 a first distance. In this manner, radial outward deflection of selectively expandable portion may be constrained or supported at a first limit as show in FIG. 4. Constraining movement of selectively expandable portion 124 limits an outward expansion of deformable section 93.

Figure 5:
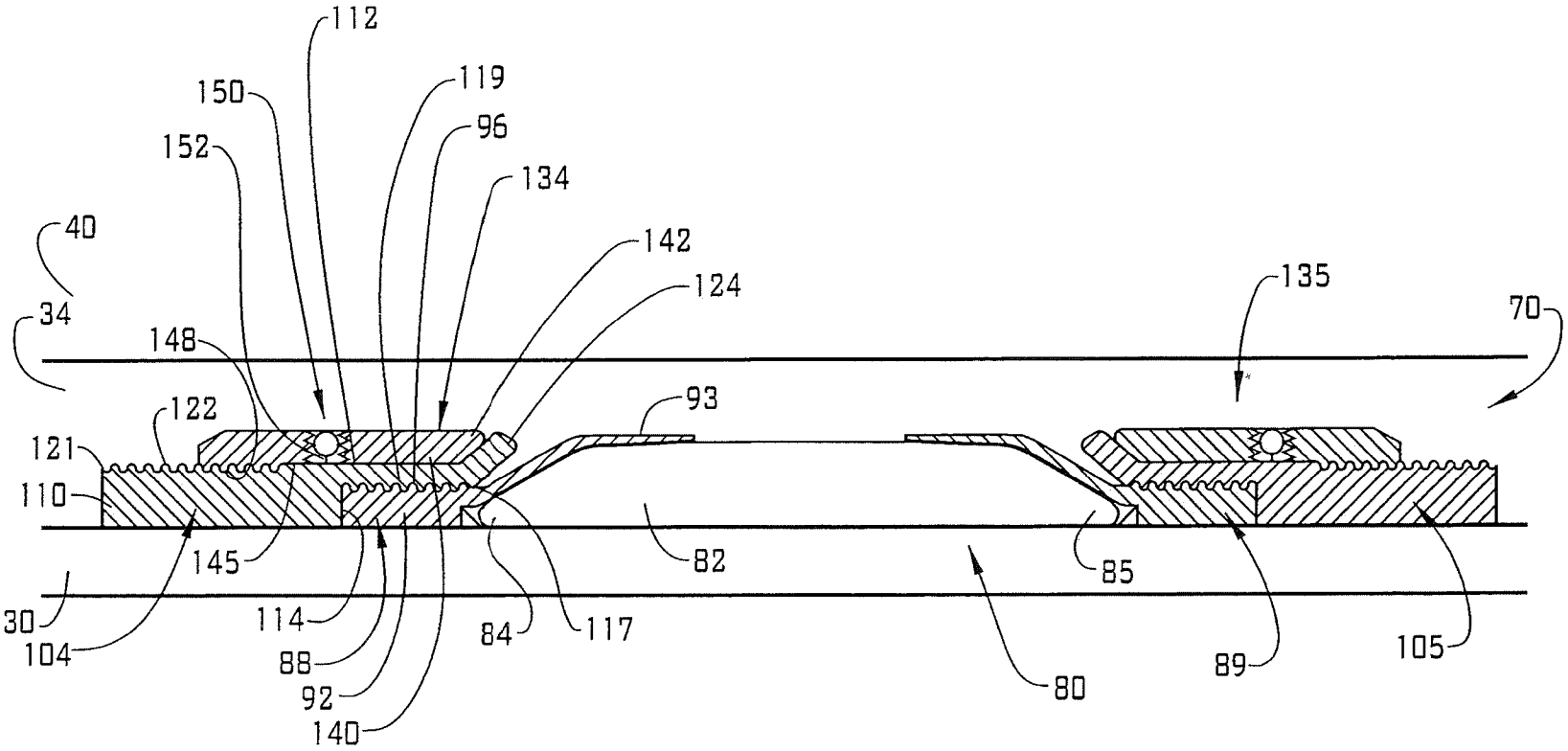
FIG. 5 depicts the adjustable packing element assembly of FIG. 1 in a second adjusted configuration, in accordance with an aspect of an exemplary embodiment.
Figure 6:
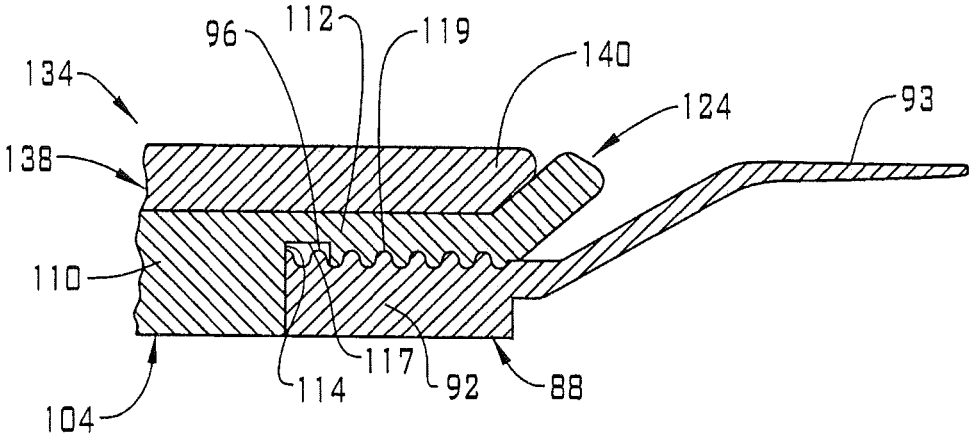
FIG. 6 depicts a first portion of the adjustable packer assembly of FIG. 5 prior to packing element expansion, in accordance with an aspect of an exemplary embodiment.
Figure 7:
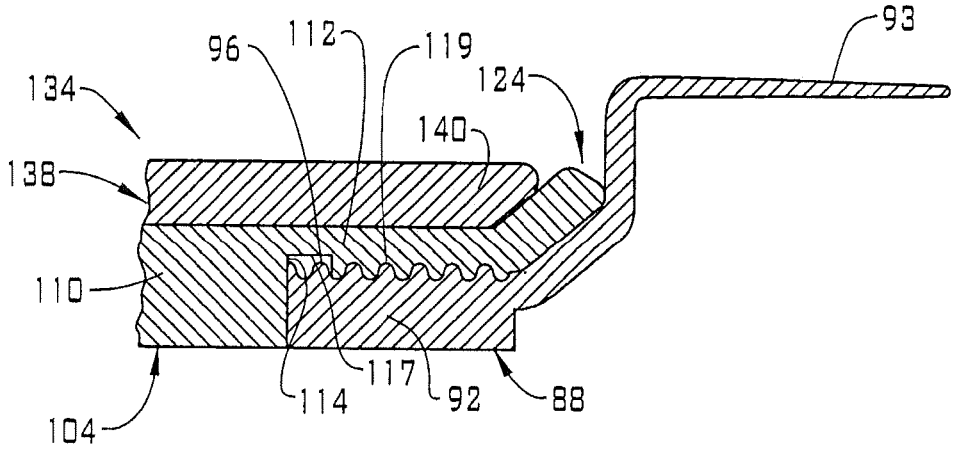
FIG. 7 depicts the first portion of the adjustable packer assembly of FIG. 6 after packing element expansion, in accordance with an aspect of an exemplary embodiment.

In another example illustrated in FIGS. 5-7, first and second adjustable sleeves 134 and 135 may be positioned relative to first and second expandable rings 104 and 105 to establish another selected amount of expansion that corresponds to another, smaller, casing diameter. For example, as shown in FIGS. 5 and 6, first adjustable sleeve 134 may be positioned on first expandable ring 104 such that travel limiter 142 abuts or nearly abuts selectively expandable portion 124. In this manner, radial outward deflection of selectively expandable portion 124 may be constrained or supported at a second limit as show in FIG. 7. Constraining movement of selectively expandable portion 124 limits an outward expansion of deformable section 93. Of course, it should be understood that the particular location of adjustable sleeve 134 may vary and may depend on a diameter of casing 40 and/or a diameter of tubular string 30.

At this point it should be understood that exemplary embodiments describe a system that promotes an adjustment for a packing element assembly. The adjustment may be made on site with minimal tooling or disruption in operations. The adjustment limits an amount of travel of the expandable ring which, in turn, limits or supports a selected amount of expansion of the back-up ring. This, the exemplary embodiments allow a particular packing element to be employed in multiple installations.

Set forth below are some embodiments of the foregoing disclosure:

Embodiment 1

An adjustable packing element assembly includes a tubular; a packing element supported by the tubular, the packing element including a first end portion and a second end portion; a backup ring arranged at the first end portion, the backup ring including a first section mounted to the tubular and a second section extending over the packing element; an expandable ring mounted to the backup ring, the expandable ring including a selectively expandable portion; and an adjustable sleeve mounted to the expandable ring, the adjustable sleeve being selectively arranged to constrain an amount of expansion of the selectively expandable portion.

Embodiment 2

The adjustable packing element assembly according to any prior embodiment, wherein the adjustable sleeve is connected to the expandable ring through a plurality of threads.

Embodiment 3

The adjustable packing element assembly according to any prior embodiment, wherein the adjustable sleeve includes a locking mechanism.

Embodiment 4

The adjustable packing element assembly according to any prior embodiment, wherein the locking mechanism comprises a lock screw extending through the adjustable sleeve and selectively engaging the expandable ring.

Embodiment 5

The adjustable packing element assembly according to any prior embodiment, wherein the expandable ring is connected to the backup ring through a plurality of threads.

Embodiment 6

The adjustable packing element assembly according to any prior embodiment, further including another backup ring arranged at the second end portion, the another backup ring including a first section mounted to the tubular and a second section extending over the packing element; another expandable ring mounted to the another backup ring, the another expandable ring including a selectively expandable portion; and another adjustable sleeve mounted to the another expandable ring, the another adjustable sleeve being selectively arranged to constrain an amount of expansion of the another expandable ring.

Embodiment 7

A resource exploration and recovery system including a first system; a second system operatively connected to the first system, the second system including at least one tubular; and an adjustable packing element assembly including a packing element supported by the tubular, the packing element including a first end portion and a second end portion; a backup ring arranged at the first end portion, the backup ring including a first section mounted to the tubular and a second section extending over the packing element; an expandable ring mounted to the backup ring, the expandable ring including a selectively expandable portion; and an adjustable sleeve mounted to the expandable ring, the adjustable sleeve being selectively arranged to constrain an amount of expansion of the selectively expandable portion.

Embodiment 8

The resource exploration and recovery system according to any prior embodiment, wherein the adjustable sleeve is connected to the expandable ring through a plurality of threads.

Embodiment 9

The resource exploration and recovery system according to any prior embodiment, wherein the adjustable sleeve includes a locking mechanism.

Embodiment 10

The resource exploration and recovery system according to any prior embodiment, wherein the locking mechanism comprises a lock screw extending through the adjustable sleeve and selectively engaging the expandable ring.

Embodiment 11

The resource exploration and recovery system according to any prior embodiment, wherein the expandable ring is connected to the backup ring through a plurality of threads.

Embodiment 12

The resource exploration and recovery system according to any prior embodiment, further including another backup ring arranged at the second end portion, the another backup ring including a first section mounted to the tubular and a second section extending over the packing element; another expandable ring mounted to the another backup ring, the another expandable ring including a selectively expandable portion; and another adjustable sleeve mounted to the another expandable ring, the another adjustable sleeve being selectively arranged to constrain an amount of expansion of the another expandable ring.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An adjustable packing element assembly comprising:

a tubular;

a packing element supported by the tubular, the packing element including a first end portion and a second end portion;

a backup ring arranged at the first end portion, the backup ring including a first section mounted to the tubular and a second section extending over the packing element;

an expandable ring mounted to the backup ring, the expandable ring including a selectively expandable portion; and an adjustable sleeve mounted to the expandable ring, the adjustable sleeve being selectively arranged to constrain an amount of expansion of the selectively expandable portion, wherein the adjustable sleeve is connected to the expandable ring through a plurality of threads.

2. The adjustable packing element assembly according to claim 1, wherein the adjustable sleeve includes a locking mechanism.

3. The adjustable packing element assembly according to claim 2, wherein the locking mechanism comprises a lock screw extending through the adjustable sleeve and selectively engaging the expandable ring.

4. The adjustable packing element assembly according to claim 1, wherein the expandable ring is connected to the backup ring through a plurality of threads.

5. The adjustable packing element assembly according to claim 1, further comprising:

another backup ring arranged at the second end portion, the another backup ring including a first section mounted to the tubular and a second section extending over the packing element;

another expandable ring mounted to the another backup ring, the another expandable ring including a selectively expandable portion; and another adjustable sleeve mounted to the another expandable ring, the another adjustable sleeve being selectively arranged to constrain an amount of expansion of the another expandable ring.

6. A resource exploration and recovery system comprising:

a first system;

a second system operatively connected to the first system, the second system including at least one tubular; and an adjustable packing element assembly comprising:

a packing element supported by the tubular, the packing element including a first end portion and a second end portion;

a backup ring arranged at the first end portion, the backup ring including a first section mounted to the tubular and a second section extending over the packing element;

an expandable ring mounted to the backup ring, the expandable ring including a selectively expandable portion; and an adjustable sleeve mounted to the expandable ring, the adjustable sleeve being selectively arranged to constrain an amount of expansion of the selectively expandable portion, wherein the adjustable sleeve is connected to the expandable ring through a plurality of threads.

7. The resource exploration and recovery system according to claim 6, wherein the adjustable sleeve includes a locking mechanism.

8. The resource exploration and recovery system according to claim 7, wherein the locking mechanism comprises a lock screw extending through the adjustable sleeve and selectively engaging the expandable ring.

9. The resource exploration and recovery system according to claim 6, wherein the expandable ring is connected to the backup ring through a plurality of threads.

10. The resource exploration and recovery system according to claim 6, further comprising:

another backup ring arranged at the second end portion, the another backup ring including a first section mounted to the tubular and a second section extending over the packing element;

another expandable ring mounted to the another backup ring, the another expandable ring including a selectively expandable portion; and another adjustable sleeve mounted to the another expandable ring, the another adjustable sleeve being selectively arranged to constrain an amount of expansion of the another expandable ring.

* * * * *